US006643847B1

(12) United States Patent
Dornak

(10) Patent No.: US 6,643,847 B1
(45) Date of Patent: Nov. 11, 2003

(54) ADAPTABLE DECORATIVE HEADWEAR

(76) Inventor: Ricky J. Dornak, 3730 Gooch Hollow Rd., Harrison, AR (US) 72601

( * ) Notice: Subject to any disclaimer, the term of this patent is extended or adjusted under 35 U.S.C. 154(b) by 0 days.

(21) Appl. No.: 10/095,188

(22) Filed: Mar. 11, 2002

(51) Int. Cl.[7] ..... A42B 1/00
(52) U.S. Cl. ..... 2/195.1
(58) Field of Search ..... 2/195.1, 175.1, 2/209.13, 195.2, 195.3, 195.4, 918; 40/329, 586

(56) References Cited

U.S. PATENT DOCUMENTS

| | | | | | |
|---|---|---|---|---|---|
| 1,676,504 | A | | 7/1928 | Risley | |
| 2,744,256 | A | * | 5/1956 | Slotkin et al. | 2/175.1 |
| 2,803,829 | A | * | 8/1957 | Tscharne | 2/209.13 |
| 5,070,545 | A | * | 12/1991 | Tapia | 2/175.1 |
| 5,410,761 | A | * | 5/1995 | Connelly et al. | 2/195.1 |
| 5,452,479 | A | * | 9/1995 | Mostert | 2/195.1 |
| 5,465,426 | A | * | 11/1995 | Beaton | 2/181 |
| 5,581,813 | A | * | 12/1996 | Henschel | 2/195.1 |
| 5,592,696 | A | | 1/1997 | Oliver | |
| 5,734,993 | A | | 4/1998 | D'Oca | |
| 5,771,493 | A | | 6/1998 | Proctor | |
| 6,061,836 | A | | 5/2000 | Peters | |
| 6,138,279 | A | | 10/2000 | Gore | |
| 6,282,721 | B1 | | 9/2001 | Travalgia | |

* cited by examiner

*Primary Examiner*—John J. Calvert
*Assistant Examiner*—Katherine Moran
(74) *Attorney, Agent, or Firm*—John D. Gugliotta; Olen L. York, III

(57) ABSTRACT

A baseball cap is provided that allows for the personalized placement of multiple logos, insignias, or text. The cap contains multiple pockets for the placement of team logos, player names, manufacturers' logos, text, pictures and the like. Each see-thru plastic pocket is independent in nature and allows the user to slip in the personalizing material through a flap. Four separate compartments would be provided on the top of the head, with another two on the bill.

2 Claims, 2 Drawing Sheets

ADAPTABLE DECORATIVE HEADWEAR

RELATED APPLICATIONS

The present invention was first described in Disclosure Document Registration 500,509 filed on Sep. 27, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to headwear and, more particularly, to a cap or hat having removable or replaceable decorative appliques.

2. Description of the Related Art

Sport caps, such as those worn by baseball players and race car teams, are favorite collectibles among the various team's fans. Similar caps are worn with logos of manufacturers or insignias or numbers of favorite players as well. Such caps depict the wearer's loyalty to the team, players, or manufacturer and a bit of their personality as well. However, due to licensing agreements, usually only one team, company, or the like can be depicted and sold as part of the cap at one time. Thus, people with multiple favorite teams, such as in various leagues, or those with favorite professional teams, college teams and even amateur teams can only show their loyalty only one team at a time.

A search of the prior art did not disclose any patents that read directly on the claims of the instant invention; however, the following references were considered related.

U.S. Pat. No. 6,282,721, issued in the name of Travalgia, describes headwear with slots for eyeglasses or sunglasses U.S. Pat. No. 6,138,279, issued in the name of Gore, describes a caps which the visor has an insert for maintaining shape U.S. Pat. No. 6,061,836, issued in the name of Peters, describes a slip-on, elastic, cover for hard hats designed to permit a logo or company name U.S. Pat. No. 5,771,493, issued in the name of Proctor, describes headwear accessorization system U.S. Pat. No. 5,734,993, issued in the name of D'Oca, describes a sports hat which a pin can be inserted that represents the sport the person intends to play U.S. Pat. No. 5,592,696, issued in the name of Oliver, describes an ornamental slip cover for the brim of a hat And, U.S. Pat. No. 1,676,504, issued in the name of Risley, describes a fit easy facing for hats, designed for use in the lining and ornamentation of hat brims Consequently, there exists a need for a means by which a single baseball cap can bear the insignias of multiple teams, players, personalities, manufacturers or the like.

SUMMARY OF THE INVENTION

It is therefore an object of the present invention to provide an improved sports cap.

It is a feature of the present invention to provide an improved cap or hat having removable or replaceable decorative appliques.

Briefly described according to one embodiment of the present invention, a baseball cap is provided that allows for the personalized placement of multiple logos, insignias, or text. Upon initial observation from a distance, the invention looks like a conventional baseball cap which fits snugly to the head and with a bill that protrudes from the forehead to provide shade for ones eyes. But after closer inspection, it can be seen that the cap contains multiple pockets for the placement of team logos, player names, manufacturers' logos, text, pictures and the like. Each see-thru plastic pocket is independent in nature and allows the user to slip in the personalizing material through a flap. It is envisioned that four separate compartments would be provided on the top of the head, with another two on the bill.

The cap can be used to represent professional teams, collegiate teams, high school teams, amateur teams, entertainment personalities, manufacturer's logs, personal photos, or any combination of the above.

The use of the present invention provides anyone who wears a baseball cap the ability of displaying their loyalty to all of their favorite teams, people, etc. in a manner which is unique, eye-catching and visually pleasing as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
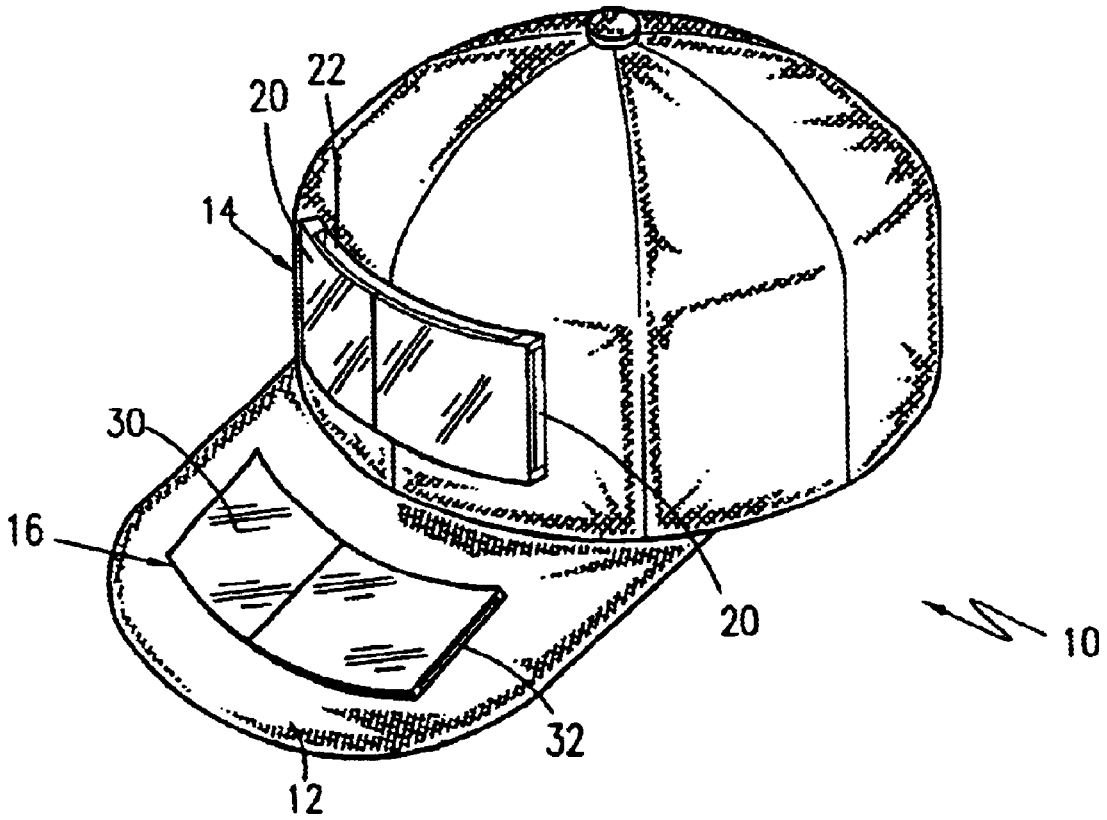
FIG. 1 is an exploded perspective view of a cap having removable or replaceable decorative appliques according to the preferred embodiment of the present invention.

Referring now to FIG. 1, an otherwise conventional baseball cap 10 is provided having an extended bill 12. The cap 10 has a first upper surface 14 and the bill has a second upper surface 16. The first upper surface 14 supports multiple pockets 20 formed of a transparent upper member secured around a portion of its perimeter against the first upper surface 14 such as to form an access slot 22. The access slot allows for the placement of team logos, player names, manufacturers' logos, text, pictures and the like that allows for the personalized placement of multiple logos, insignias, or text. Each see-thru pocket 20 is independent in nature and allows the user to slip in the personalizing material through the slot 22. Similarly, the second upper surface 16 supports multiple pockets 30 formed of a transparent upper member secured around a portion of its perimeter against the second upper surface 16 such as to form a second access slot 32. The access slot allows for the placement of team logos, player names, manufacturers' logos, text, pictures and the like that allows for the personalized placement of multiple logos, insignias, or text.

It is envisioned that four separate compartments would be provided on the top of the head (not shown), with another two on the bill.

Figure 2:
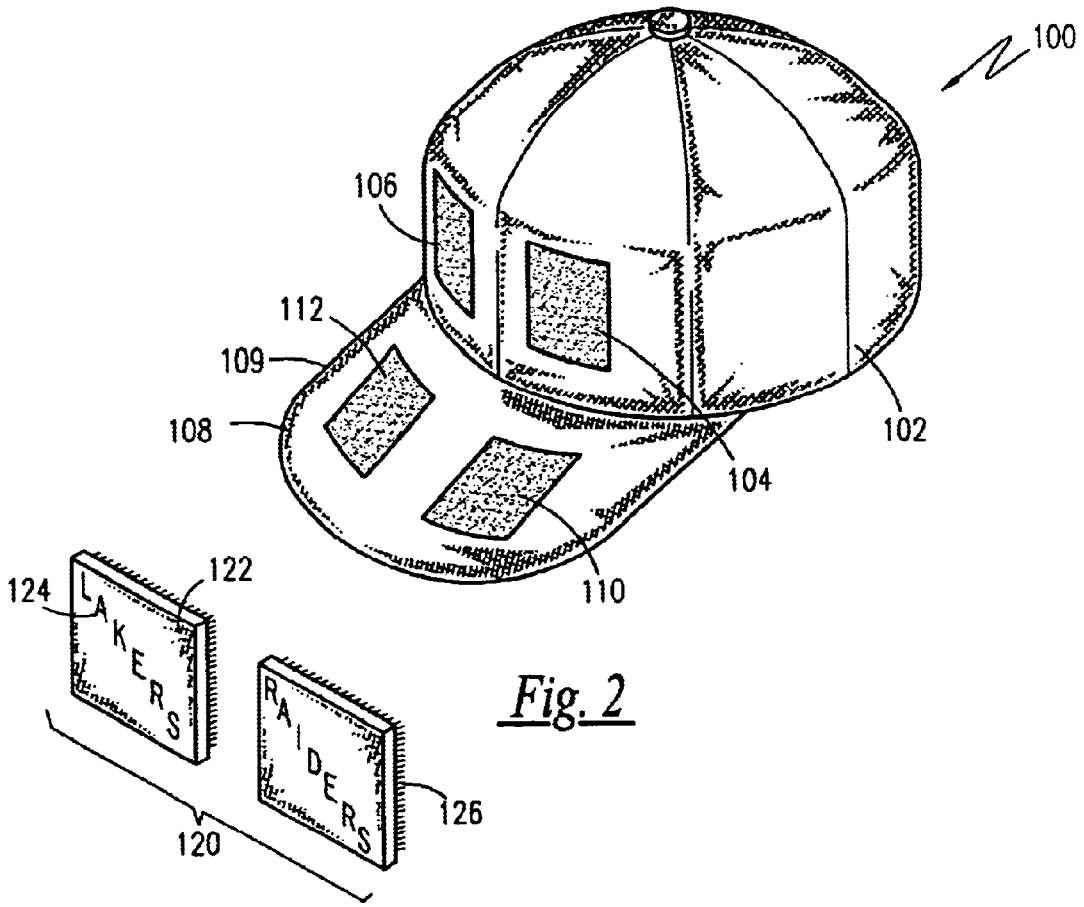
FIG. 2 is an exploded perspective view of a cap having removable or replaceable decorative appliques according to an alternate embodiment thereof.

Referring to FIG. 2, an alternate embodiment for a cap or hat having removable or replaceable decorative appliques. In this embodiment, the cap 100 has a first upper surface 102 supporting a first indicia supporting facie 104 and a second indicia supporting facie 106. The bill 109 has a second upper surface 108 supporting a third indicia supporting facie 110 and a fourth indicia supporting facie 112. It is envisioned that each indicia supporting facie 104, 106, 110, 112 is formed of a loop fastener element for use with a hook and loop fastener. In conjunction with this embodiment, a plurality of various decorative indicia appliques 120 are each formed of an applique backing 122 having a design 124 on a front surface and a hook fastener element 126 on a back surface. The design 124 is can be of screen print or embroidered type.

It is envisioned that various decorative indicia appliques 120 can be thereby affixed to the cap or bill.

2. Operation of the Preferred Embodiment

In operation, the present invention is used as any other cap or hat, but can be adapted to be customized by the user to bear the insignias of multiple teams, players, personalities, manufacturers or the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A baseball cap with an extended bill comprising:

a first upper surface formed on said cap, wherein said first upper surface supports multiple pockets formed of a transparent upper member secured around a portion of its perimeter against the first upper surface such as to form an access slot;

a second upper surface formed on said bill, wherein said second upper surface supports multiple pockets formed of a transparent upper member secured around a portion of its perimeter against the second upper surface such as to form an access slot;

wherein said access slot allows for the placement of team logos, player names, manufacturers' logos, text, and pictures that allows for the personalized placement of multiple logos, insignias, or text.

2. The cap of claim 1, wherein each transparent pocket is independent in nature and allows the user to slidably insert personalizing material through said slot.

* * * * *